US010459404B2

(12) United States Patent
Inoue

(10) Patent No.: US 10,459,404 B2
(45) Date of Patent: Oct. 29, 2019

(54) IMAGE FORMING APPARATUS PERFORMING IMAGE FORMATION WITH DETACHABLE CARTRIDGE AND CARTRIDGE DETACHABLE FROM IMAGE FORMING APPARATUS

(71) Applicant: CANON KABUSHIKI KAISHA, Tokyo (JP)

(72) Inventor: Naoki Inoue, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/992,663

(22) Filed: May 30, 2018

(65) Prior Publication Data

US 2018/0348701 A1 Dec. 6, 2018

(30) Foreign Application Priority Data

Jun. 6, 2017 (JP) ..... 2017-112025
Apr. 2, 2018 (JP) ..... 2018-071044

(51) Int. Cl.
*G03G 21/18* (2006.01)
*G03G 15/01* (2006.01)
*G03G 15/00* (2006.01)

(52) U.S. Cl.
CPC ..... *G03G 21/1889* (2013.01); *G03G 15/0178* (2013.01); *G03G 15/55* (2013.01); *G03G 21/1807* (2013.01); *G03G 21/1839* (2013.01); *G03G 21/1892* (2013.01); *G03G 15/0189* (2013.01); *G03G 21/1814* (2013.01)

(58) Field of Classification Search
None
See application file for complete search history.

(56) References Cited

U.S. PATENT DOCUMENTS

2011/0311238 A1* 12/2011 Ajima ..... G03G 15/553 399/12

FOREIGN PATENT DOCUMENTS

JP 2007-240928 A 9/2007

* cited by examiner

*Primary Examiner* — Victor Verbitsky
(74) *Attorney, Agent, or Firm* — Venable LLP

(57) ABSTRACT

An image forming apparatus includes a formation unit configured to form an image by using a plurality of cartridges that are detachable from the image forming apparatus, each cartridge having a storage unit and a member for forming the image; and a control unit configured to set an image forming condition for image formation. The control unit reads identification information from each storage unit of at least two cartridges out of the plurality of cartridges, the identification information indicating a version of a corresponding cartridge, and the control unit sets the image forming condition based on a combination of versions of the at least two cartridges.

20 Claims, 13 Drawing Sheets

FIG. 5A

| | | | | |
|---|---|---|---|---|
| ⋮ | | | | |
| IDENTIFICATION INFORMATION = 1 | | | | |
| ⋮ | | | | |
| SECONDARY TRANSFER CORRECTION REFERENCE VALUE | +10V | | | |
| SECONDARY TRANSFER CORRECTION LEVEL | 1 | 1 | 1 | 1 |
| | 1 | 1 | 1 | 1 |
| | 1 | 2 | 1 | 1 |
| | – | 3 | 2 | 2 |
| FIXATION CORRECTION REFERENCE VALUE | -10℃ | | | |
| FIXATION CORRECTION LEVEL | 0 | 1 | 0 | 1 |
| | 0 | 1 | 0 | 1 |
| | 0 | 2 | 0 | 1 |
| | – | 3 | 1 | 2 |

503

502

516

IMAGE FORMING APPARATUS PERFORMING IMAGE FORMATION WITH DETACHABLE CARTRIDGE AND CARTRIDGE DETACHABLE FROM IMAGE FORMING APPARATUS

BACKGROUND OF THE INVENTION

Field of the Invention

The present invention relates to an image forming apparatus that is operable to perform image formation in accordance with an electronic photographic method, an electrostatic recording method, or the like, and in particular relates to an image forming apparatus in which a detachable cartridge is installed and that is operable to perform image formation.

Description of the Related Art

An image forming apparatus performs image formation after a cartridge, which is a consumable and is detachable from a main body, is installed. Here, there are cases were a material or the like of a member included in a cartridge can be changed after being initially used. When the material of a member included in a cartridge is changed, there are cases where an image forming condition must change in response thereto. Japanese Patent Laid-Open No. 2007-240928 discloses a configuration for providing a storage device in a cartridge, and forming an image by an appropriate image forming condition based on information stored in the storage device.

However, in an image forming apparatus having a plurality of cartridges, there can be cases where the image forming apparatus is installed with a mixture of cartridges for which the material of the member has been changed and cartridges for which there is no change, in other words cartridges having different versions. In such a case, when an image forming condition based on information stored in the storage device of a cartridge for which the material of a member has been changed is set, appropriately forming an image may cease to be possible.

SUMMARY OF THE INVENTION

According to an aspect of the present invention, an image forming apparatus includes: a formation unit configured to form an image by using a plurality of cartridges that are detachable from the image forming apparatus, each cartridge having a storage unit and a member for forming the image; and a control unit configured to set an image forming condition for image formation. The control unit reads identification information from each storage unit of at least two cartridges out of the plurality of cartridges, the identification information indicating a version of a corresponding cartridge, and the control unit sets the image forming condition based on a combination of versions of the at least two cartridges.

Further features of the present invention will become apparent from the following description of exemplary embodiments with reference to the attached drawings.

BRIEF DESCRIPTION OF THE DRAWINGS

FIGS. 5A and 5B are views illustrating information stored in the storage device according to an embodiment.

DESCRIPTION OF THE EMBODIMENTS

Exemplary embodiments of the present invention will be described hereinafter, with reference to the drawings. Note, the following embodiments are examples and the present invention is not limited to the content of the embodiments. Also, for the following drawings, elements that are not necessary in the explanation of the embodiment are omitted from the drawings.

First Embodiment

Figure 1:
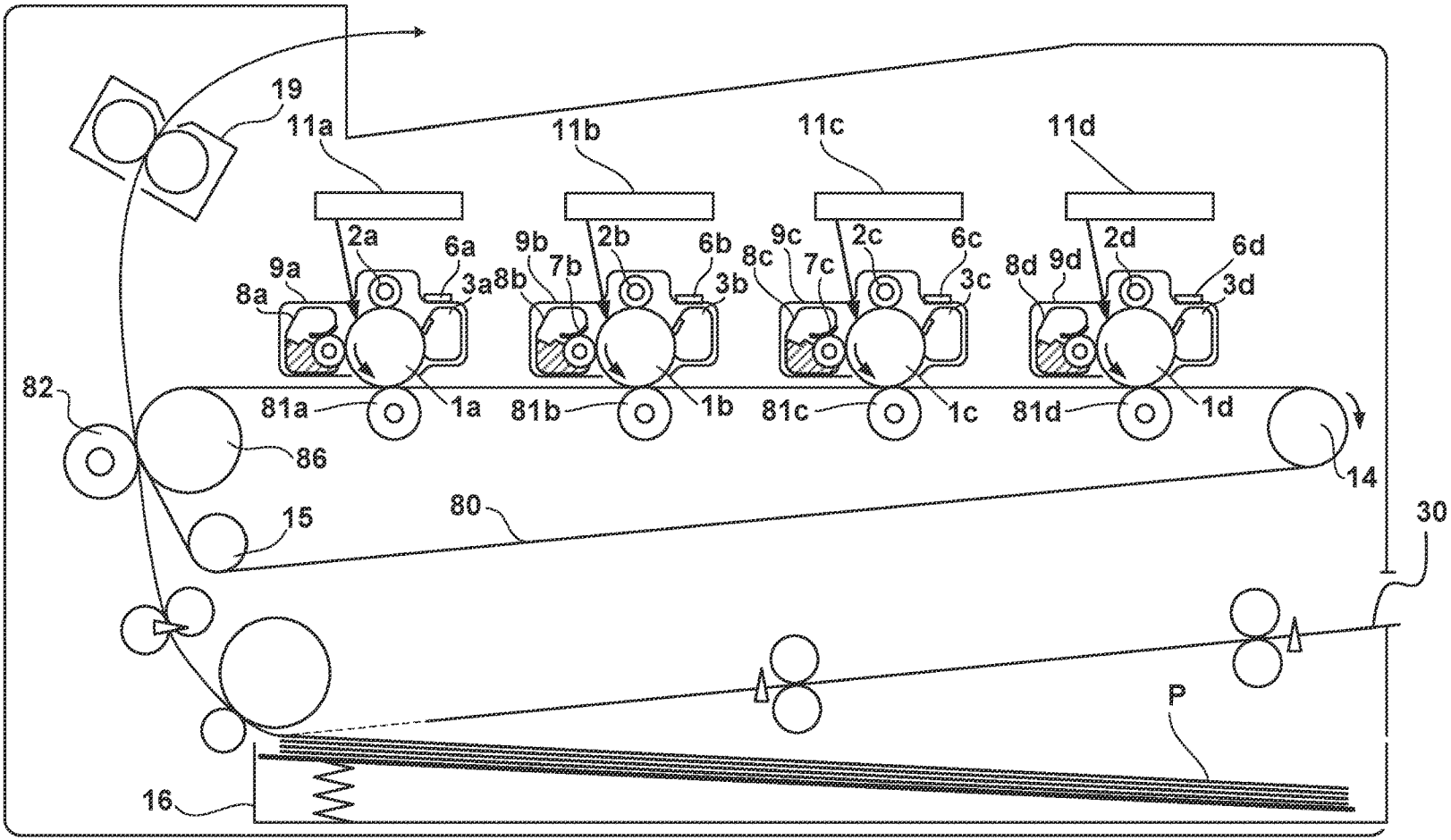
FIG. 1 is a configuration diagram of an image forming apparatus according to an embodiment.

FIG. 1 is a configuration diagram of the image forming apparatus according to this embodiment. In FIG. 1, the letters a, b, c, and d at the end of reference numerals indicate that the color of toner for forming by a corresponding member is yellow, magenta, cyan, and black, respectively. However, in a case there is no need to distinguish colors, a reference numeral omitting letters from the end is used. A photosensitive member 1 is an image carrier and is rotated in a direction of an arrow symbol in the drawing at a time of image formation. A charging roller 2 outputs a charging bias to cause a surface of the photosensitive member 1 which is rotated to be charged to a uniform potential. An exposure unit 11 scans/exposes the charged photosensitive member 1 with light to form an electrostatic latent image on the photosensitive member 1. A developing unit 8 has toner and outputs a developing bias to causes cause toner to adhere to the electrostatic latent image of the photosensitive member 1 and form a toner image on the photosensitive member 1. A primary transfer roller 81 outputs a primary transfer bias to transfer the toner image of the photosensitive member 1 to an intermediate transfer belt 80 which is a transfer body. A cleaning unit 3 recovers toner remaining on the photosensitive member 1 that is not transferred to the intermediate transfer belt 80. The photosensitive member 1, the charging roller 2, the developing unit 8, and the cleaning unit 3 are configured as an integrated type cartridge 9 that is detachable from the main body of the image forming apparatus. In addition, the cartridge 9 further has a storage device 6.

The intermediate transfer belt 80 is stretched/supported by a secondary transfer opposing roller 86, a driving roller 14, and a tension roller 15, and is rotated depending on rotation of the driving roller 14 at a time of image formation. A sheet from a cassette 16 or a sheet inserted from a sheet feed port 30 is conveyed toward a nip region between a secondary transfer roller 82 and the secondary transfer opposing roller 86 by a plurality of rollers provided along a conveyance path. The secondary transfer roller 82 outputs a secondary transfer bias to thereby transfer the toner image of the intermediate transfer belt 80 to a sheet. The sheet to which the toner image is transferred is conveyed to a fixing unit 19. The fixing unit 19 heats/pressurizes the sheet to cause the toner image to be fixed to the sheet. After fixing of the toner image, the sheet is discharged to outside of the image forming apparatus.

Figure 2:
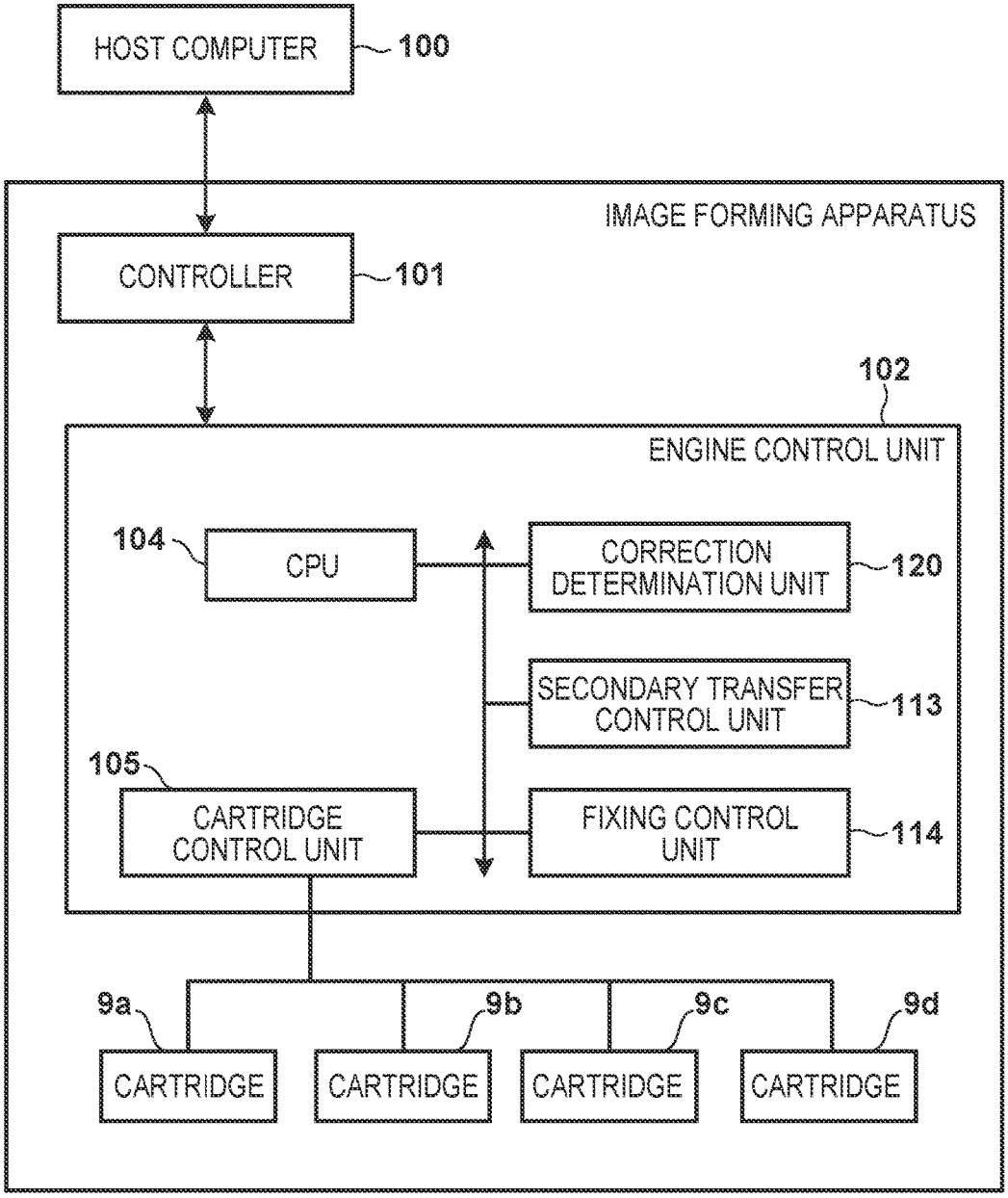
FIG. 2 is a control configuration diagram of the image forming apparatus according to an embodiment.

FIG. 2 is a control configuration diagram of the image forming apparatus according to this embodiment. A controller 101 communicates with an external host computer 100, and controls an engine control unit 102 to perform image formation upon receiving, for example, an instruction regarding image formation from the host computer 100. A CPU 104 of the engine control unit 102 controls other functional blocks of the engine control unit 102. Here, a cartridge control unit 105 controls each member of the cartridge 9, a secondary transfer control unit 113 controls secondary transfer processing by the secondary transfer roller 82, and a fixing control unit 114 controls a fixing process by the fixing unit 19. A correction determination unit 120 determines necessity for correction of an image forming condition from information stored in the storage device 6 of each cartridge 9, and calculates a correction value when correction is necessary. Below, description is given regarding the embodiment assuming that image forming conditions for determining necessity of correction based on information stored in the storage device 6 are a secondary transfer bias (a secondary transfer condition) and a fixing temperature of the fixing unit 19 (a fixing condition). Note that configuration may be taken to execute functionality of the correction determination unit 120 by the CPU 104.

Figure 3:
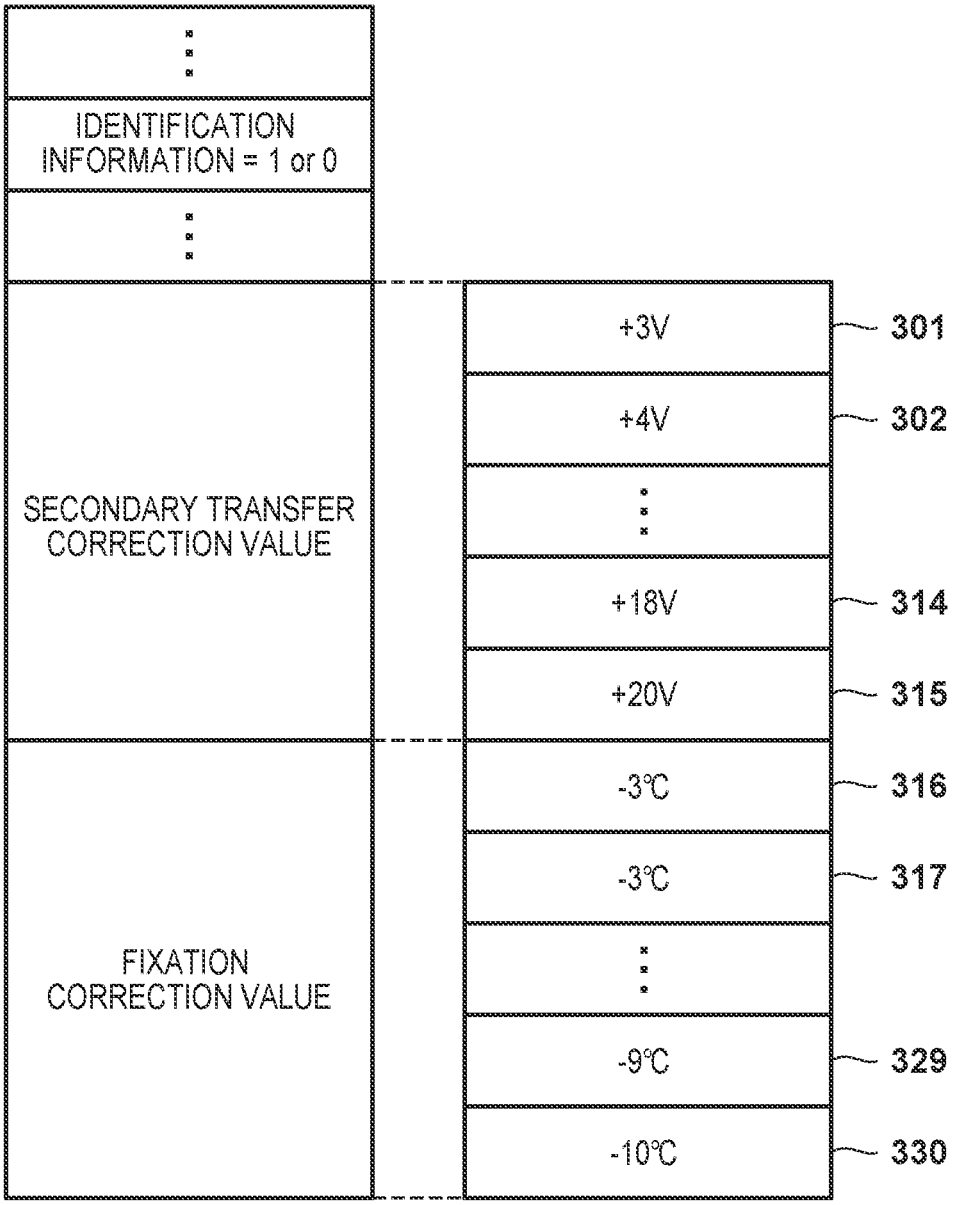
FIG. 3 is a view illustrating information stored in a storage device according to an embodiment.

FIG. 3 is a view for describing information stored in the storage device 6 in the present embodiment. Identification information is information indicating whether toner material has been changed. In the present embodiment it is assumed that the identification information being 0 indicates that toner material has not been changed from an initial material, and the identification information being 1 indicates that toner material has been changed from an initial material. When the identification information is 1, correction information is stored in a predetermined region of the storage device 6. In the present embodiment, because image forming conditions that are control targets are the secondary transfer bias and the fixing temperature, each of a secondary transfer correction value and a fixation correction value are stored as correction information. Here, because image formation is performed with four cartridges 9*a* through 9*d* installed in the present embodiment, there are 16 combinations of identification information values stored in respective storage devices 6. Out of these, because there is no necessity for correction of the image forming condition for the combination where the identification information of all of the storage devices 6 is 0, 15 correction values are respectively set for the secondary transfer correction value and the fixation correction value.

Note that, in the following description, a combination of values of identification information stored in the four storage devices 6*a* through 6*d* are represented by a combined value that lines up the values of the identification information in the order of the storage devices 6*a*, 6*b*, 6*c*, and 6*d*. For example, when the identification information of the storage devices 6*a*, 6*b*, and 6*c* are 1 and the identification information of the storage device 6*d* is 0, the combined value is "1110".

In relation to the secondary fixation correction value, a reference numeral 301 of FIG. 3 is a correction value applied when the combined value is "0001", and a reference numeral 302 is a correction value applied when the combined value is "0010". In addition, a reference numeral 314 is a correction value applied when the combined value is "1110", and a reference numeral 315 is a correction value applied when the combined value is "1111". Similarly for fixation correction values, a reference numeral 316 of FIG. 3 is a correction value applied when the combined value is "0001", and a reference numeral 317 is a correction value applied when the combined value is "0010". In addition, a reference numeral 329 is a correction value applied when the combined value is "1110", and a reference numeral 330 is a correction value applied when the combined value is "1111".

For example, when the identification information of the storage devices 6*a*, 6*b*, and 6*c* is 1 and the identification information of the storage device 6*d* is 0, the combined value is "1110". In such a case, the correction determination unit 120 notifies the secondary transfer control unit 113 to cause the secondary transfer bias to increase by 18V from a reference value, and notifies the fixing control unit 114 to cause the fixing temperature to decrease by 9 degrees from a reference value. Note that the reference value of the secondary transfer bias and the reference value of the fixing temperature are set in the image forming apparatus in advance, for example. Alternatively, the reference value of the secondary transfer bias or the reference value of the fixing temperature is obtained by the image forming apparatus in accordance with a calculation based on environmental conditions or the like at the time, based on a parameter that is set in the image forming apparatus in advance.

Figure 4:
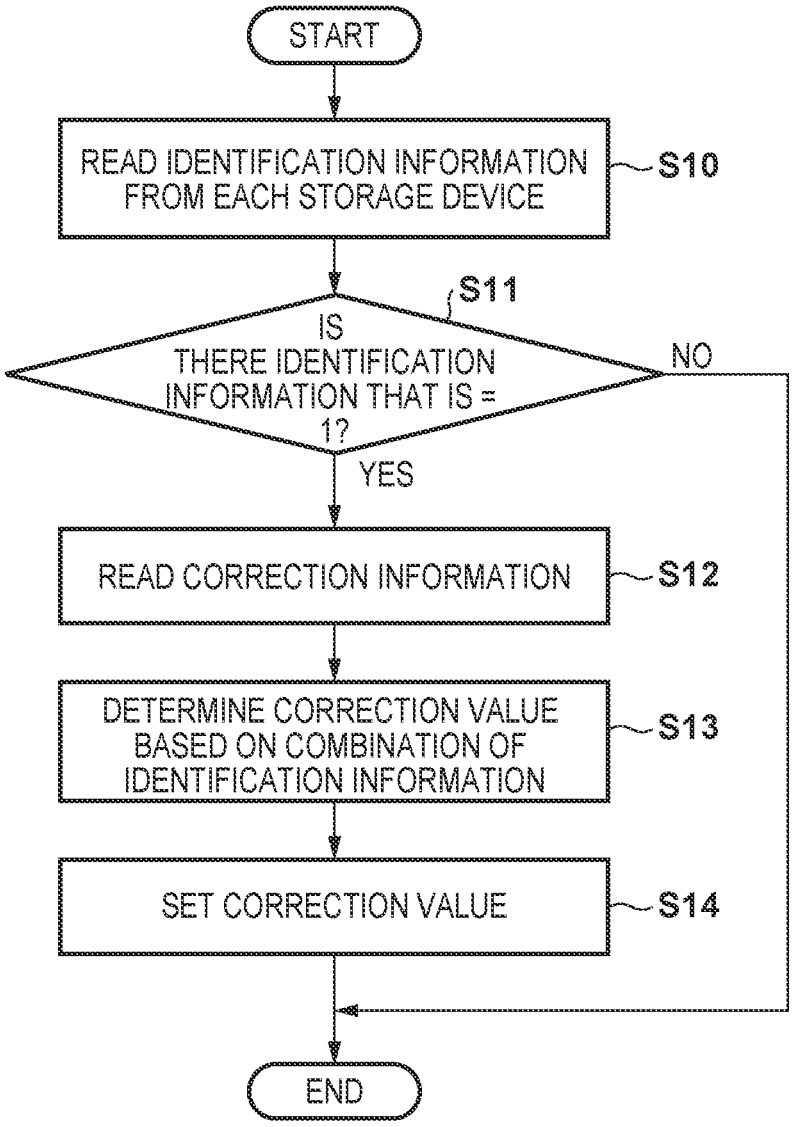
FIG. 4 is a flowchart of correction processing of the image forming condition according to an embodiment.

FIG. 4 is a flowchart of correction processing of the image forming condition according to the present embodiment. In step S10, the correction determination unit 120 reads identification information from each storage device 6, and in step S11, determines whether there is a storage device 6 for which 1 is set as the identification information. When all of the identification information is 0, the correction determination unit 120 ends processing because correction of an image forming condition is not necessary. Meanwhile, when there is a storage device 6 for which 1 is set as identification information in step S11, the correction determination unit 120 reads correction information from the storage device 6 for which 1 is set as identification information. The correction determination unit 120, in step S13, determines correction values for image forming conditions from a combination of identification information as described using FIG. 3. In step S14, the correction determination unit 120 updates the image forming conditions based on the determined correction values for the image forming conditions.

By the above configuration, it is possible to set appropriate image forming conditions even in a case where a mixture of cartridges for which a change of material has been performed and cartridges for which a change of material has not been performed are installed.

Second Embodiment

Subsequently, description is given regarding the second embodiment focusing on points of difference with the first embodiment. In the first embodiment, the identification information being 0 indicated that the material of a member of a corresponding cartridge 9 had not been changed (was an initial material), and the identification information being 1 indicated that the material had been changed. However, there may be cases where the material is changed two or more times from an initial material. In such a case, it is sufficient if the identification information is made to be version information indicating a version of the material of a member of the cartridge 9, instead of binary information of "0" or "1". In other words, by setting an initial version of "0" to a cartridge 9 that is using an initial material and increasing the value of identification information by 1 each time the material is changed, it is possible to represent a plurality of changes to the material in accordance with the identification information. However, in this case, there is a larger number of combinations of the values of identification information, and the number of correction values that must be stored in the storage device 6 also increases. For example, when 0, 1, 2, and 3 are mixed as identification information, it is necessary to set $3^4-1=80$ correction values for one image forming condition. The present embodiment handles second and subsequent material changes, and suppresses an increase of a data amount for correction information stored in the storage device 6.

Figure 5B:
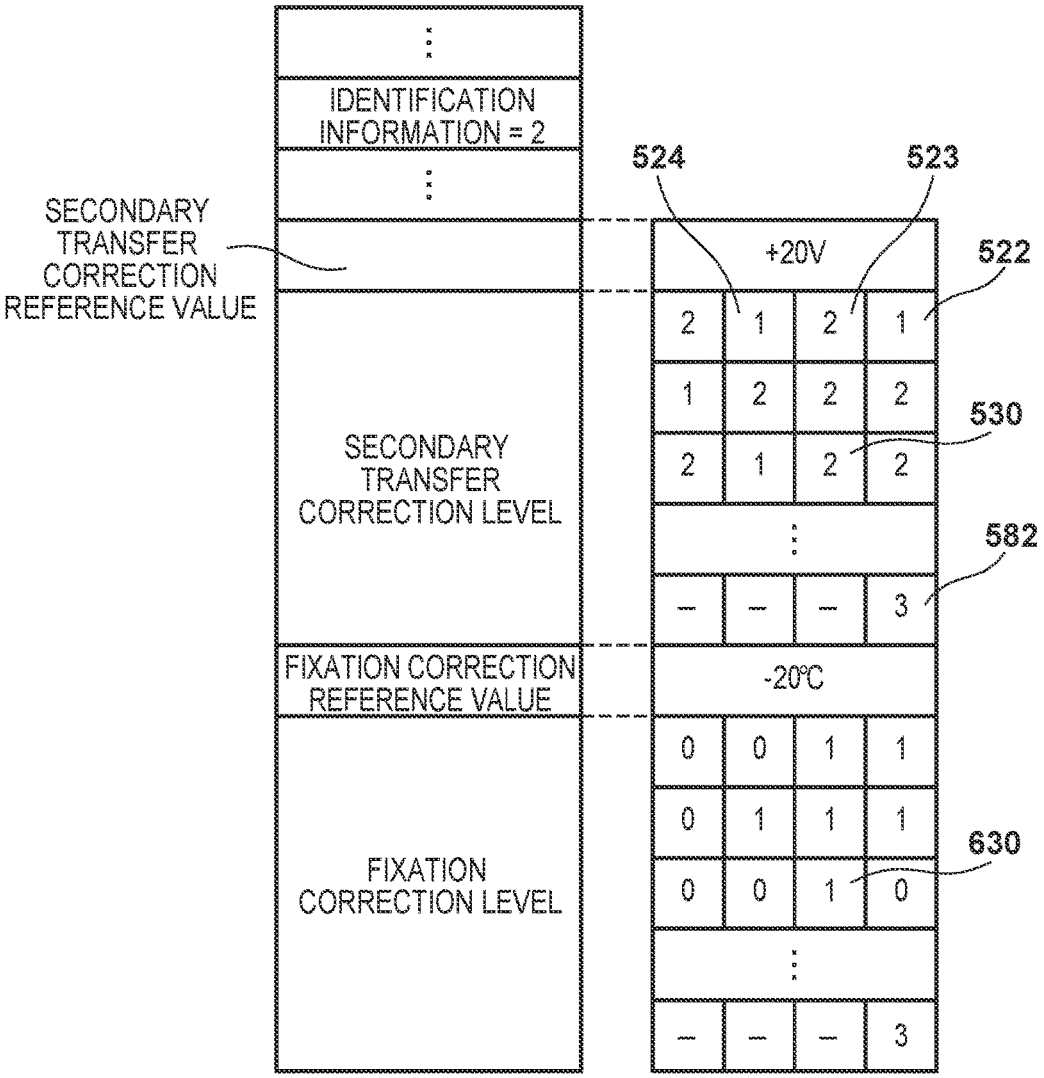

FIG. 5A and FIG. 5B are views for describing information stored in the storage device 6 in the present embodiment. FIG. 5A illustrates information recorded in the storage device 6 when toner material is first changed, and sets 1 to the identification information for the first change. In addition, correction information of the present embodiment is configured by a correction reference value and a correction level. Note that image forming conditions that are control targets in the present embodiment are also the secondary transfer bias and the fixing temperature, and two correction reference values, in other words a secondary transfer correction reference value and a fixation correction reference value, are stored in each storage device 6. Similarly, two correction levels, a secondary transfer correction level and a fixation correction level, are also stored in each storage device 6. Here, the correction level is information indicating a ratio with respect to a correction reference value of a correction value, and one correction level is represented by two bits in the present example. In other words, 0 through 3 are used as the correction level. Here, in the present example, the correction level being 0, 1, 2, or 3 is assumed to mean that the ratio with respect to the correction reference value of the correction value is respectively 0%, 33%, 67%, or 100%.

As described by the first embodiment, when there is a change for the first time, 15 correction levels are set for each image forming condition because there are 15 combinations of identification information for which correction is necessary. In regard to secondary transfer bias, a reference numeral 502 of FIG. 5A is a correction level when the combined value of identification information is "0001", and a reference numeral 503 is a correction level when the combined value is "0010". In addition, a reference numeral 516 is a correction level for when the combined value is "1111". For example, when the combined value of identification information read from installed cartridges 9 is "0001", because the correction level is 1, in other words 33%, the correction value for the secondary transfer bias is +3.3V which is 33% of the +10V set as the secondary transfer correction reference value. It is the same for the fixing condition.

FIG. 5B illustrates information recorded in the storage device 6 of a cartridge 9 having toner for which a second change of a material has been performed. Because this is the second change, 2 is set to the identification information. There are $3^4=81$ combinations of identification information, and out of these, the number of combinations that include even a single 2 as the identification information is 61. Accordingly, when the identification information illustrated in FIG. 5B has a 2, 61 correction levels are stored for each image forming condition. In FIG. 5B, reference numbers 522, 523, and 524 indicate correction levels of a secondary transfer bias when the combined value of the identification information is respectively "0002", "0012", and "0020". In addition, in FIG. 5B, a reference numeral 530 indicates a correction level of the secondary transfer bias when the combined value of the identification information is "0122". Furthermore, a reference numeral 582 indicates a correction level of the secondary transfer bias when the combined value of the identification information is "2222". Furthermore, a reference numeral 630 indicates a correction level of the fixing temperature when the combined value of the identification information is "0122".

For example, it is assumed that the combined value of identification information read from the storage device 6 of installed cartridges 9 is "0122". In such a case, as indicated by the reference numeral 530, because the correction level of the secondary transfer bias is 2 (67%), the correction value is 67% of +20V, which is the secondary transfer correction reference value, in other words +13.4V. Similarly, as indicated by the reference numeral 630, because the correction level of the fixing temperature is 1 (33%), the correction value is 33% of −20 degrees, which is the fixing temperature reference value, in other words −6.7 degrees.

Figure 6:
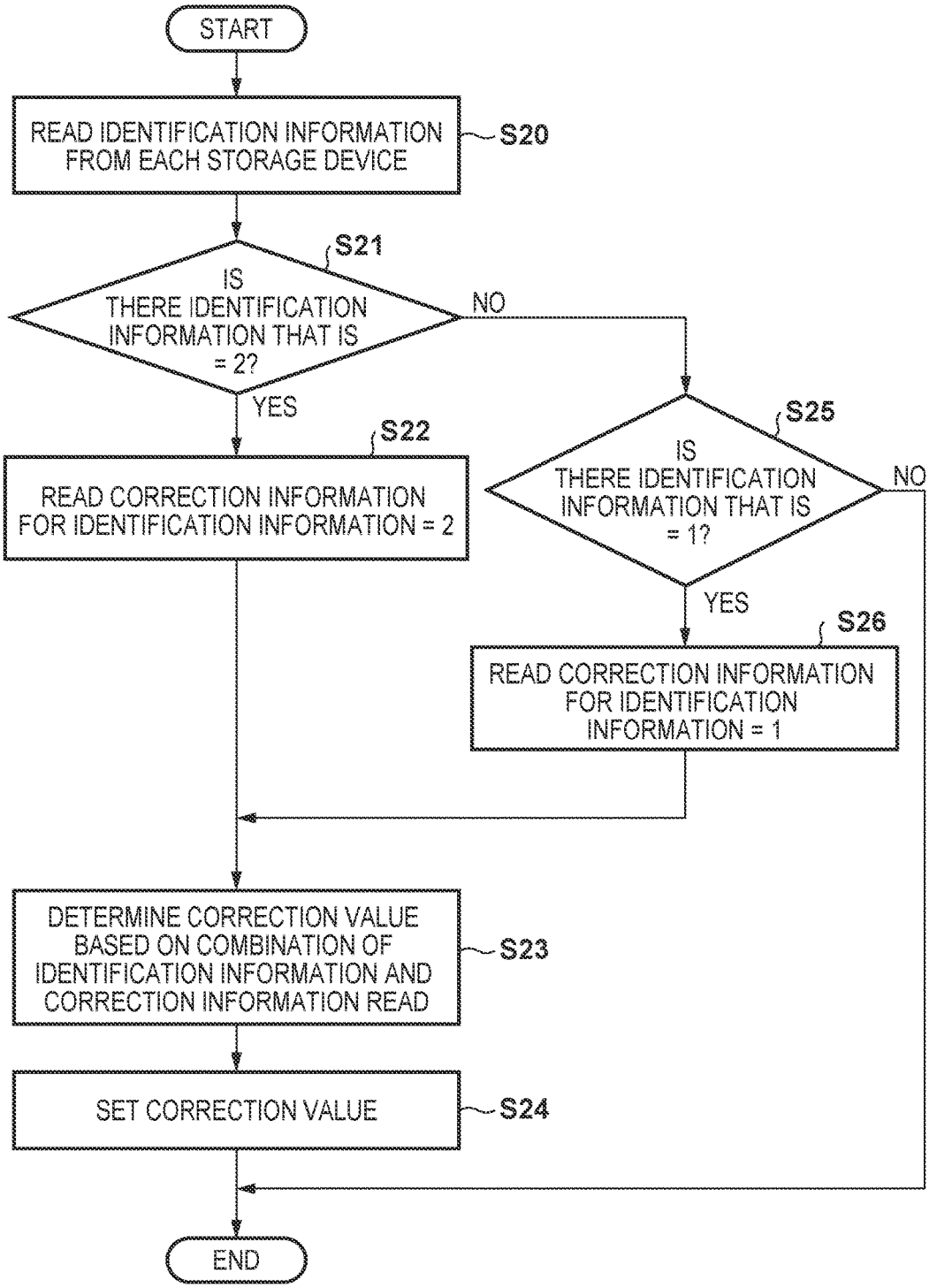
FIG. 6 is a flowchart of correction processing of the image forming condition according to an embodiment.

FIG. 6 is a flowchart of correction processing of the image forming condition according to the present embodiment. In step S20, the correction determination unit 120 reads identification information from each storage device 6, and in step S21, determines whether there is a storage device 6 for which 2 is set as the identification information. When there is a storage device 6 for which 2 is set as identification information, the correction determination unit 120, in step S22, reads correction information from the storage device 6 for which 2 is set as identification information. The correction determination unit 120, in step S23, determines correction values for image forming conditions based on a combination of identification information and the correction information read as described using FIG. 5B. In step S24, the correction determination unit 120 updates the image forming conditions based on the determined correction values for the image forming conditions.

Meanwhile, when there is no storage device 6 for which 2 is set as identification information in step S21, the correction determination unit 120, in step S25, determines whether there is storage device 6 for which 1 is set as identification information. When there is a storage device 6 for which 1 is set as identification information, the correction determination unit 120, in step S26, reads correction information from the storage device 6 for which 1 is set as identification information. Subsequently, in step S23, a correction value for the image forming condition is determined based on the combination of identification information and the correction information read, and set in step S24. Note that, in step S25, when there are no storage devices 6 for which 1 is set as identification information, the correction determination unit 120 ends processing because correction of the image forming condition is not necessary.

Note that the flowchart of FIG. 6 is for when the maximum value of identification information is 2, but it is similar in the case where the maximum value of identification information is 3 or more. Specifically, the correction determination unit 120 reads the identification information from the storage devices 6 of the installed cartridges 9. The correction determination unit 120 determines the maximum value of the identification information, reads out correction information from the storage device 6 that stores the identification information having the determined maximum value, and determines a correction value based on the combined value and the read correction information.

By the above configuration, it is possible to set an appropriate image forming condition even if change of a material is performed two times or more. In addition, it is possible to reduce a data amount for correction information by indicating a correction value by a ratio with respect to a correction reference value and not the correction value. Furthermore, by storing only the correction level of a combination that includes values set as identification information and not all combinations of identification information, it is possible to reduce a data amount of correction information. Note that description is given for the case where the correction level being 0, 1, 2, or 3 in FIG. 5A and FIG. 5B is assumed to mean that the ratio with respect to the correction reference value of the correction value is respectively 0%, 33%, 67%, or 100%. However, there is no limitation to a ratio as a correction value allocated to a correction level. For example, configuration may be taken such that, in the case of a secondary transfer correction, +0V, +6V, +12V, and +20V to add to the secondary transfer correction reference value are allocated to the correction levels 0, 1, 2, and 3, and the correction determination unit 120 corrects the secondary transfer bias as the image forming condition. In addition, in the case of a fixing temperature (bias) correction, configuration may be taken such that −0° C., −3° C., −6° C., and −10° C. with respect to a current level for a fixation correction reference value are allocated to correction levels 0, 1, 2, and 3, and the correction determination unit 120 corrects the fixing temperature. In this way, configuration may be taken to set the correction levels 0, 1, 2, and 3 to values that indicate correction values instead of values that indicate a ratio for the correction value. In such a case, when the correction determination unit 120 reads the correction level, the correction determination unit 120 reads a correction value set in advance that corresponds to a value of the correction level, and uses it in correction.

Third Embodiment

Subsequently, description is given regarding the third embodiment focusing on points of difference with the first embodiment. In the first embodiment, correction information was uniformly stored for a storage device 6 of a cartridge 9 for which a material was changed. For example, when material of the yellow cartridge 9*a* and the black cartridge 9*d* are changed, the same correction information is stored to the storage devices 6*a* and 6*d*. In the present embodiment, a memory capacity is economized by recording correction information to only the storage device 6*d* for the black cartridge 9*d* for which an influence of a fixing temperature and a secondary transfer bias with respect to change of toner material is largest.

Figure 7B:
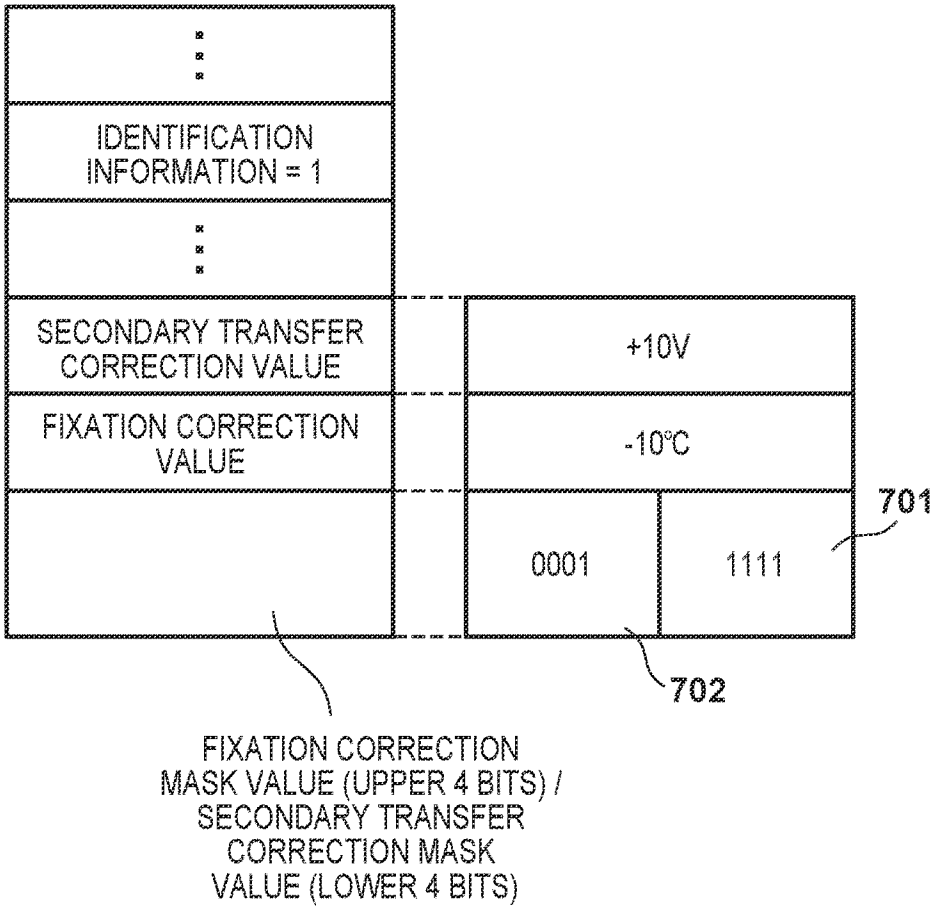
FIGS. 7A and 7B are views illustrating information stored in the storage device according to an embodiment.
Figure 7A:
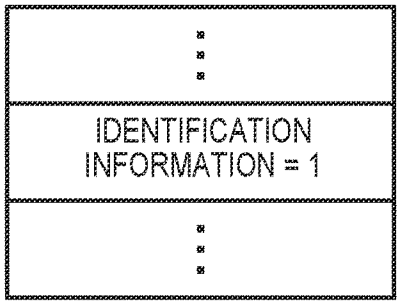

FIG. 7A and FIG. 7B are views for describing information stored in the storage device 6 in the present embodiment. FIG. 7A is information stored in the storage devices 6*a* through 6*c* for the yellow, cyan, and magenta cartridges 9*a* through 9*c* for which the toner material has changed. Although 1 is set to the identification information due to the change of the toner material, the correction information is not stored. FIG. 7B is information stored in the storage device 6*d* for the black cartridge 9*d* for which the toner material has changed. 1 is set to the identification information due to the change of the toner material, and the correction information is stored. The correction information of the present embodiment includes a correction value and a correction mask value for each image forming condition that is a control target. In the present embodiment, because image forming conditions that are the control targets are the secondary transfer bias and the fixing temperature, a secondary transfer correction value and a fixation correction value are stored as correction values. In addition, a fixation correction mask value and a secondary transfer correction mask value are stored as correction mask values.

A correction mask value is information indicating to what combination of identification information to apply a correction value. In the present example, each correction mask value is a 4-bit value, a calculation of a logical product with the combined value of identification information is performed, and if the result is equal to the correction mask value it is determined that correction is necessary, and if the result is not equal to the correction mask value it is determined that correction is unnecessary.

Specifically, in FIG. 7B, because a secondary transfer correction mask value indicated by a reference numeral 701 is all 1s, it is determined that correction is necessary when the combined value of pieces of identification information read from the storage devices 6 of the cartridges 9 that are installed is "1111". Note that because the secondary transfer correction value is +10V, the secondary transfer bias will increase by 10V in a case of executing correction. In contrast, because a fixation correction mask value indicated by a reference numeral 702 is "0001", it is determined that correction is necessary when at least the identification information of the storage device 6*d* of the black cartridge 9*d* is 1, irrespective of the values of the pieces of identification information of the storage devices 6 of other cartridges 9. Note that, because the fixation correction value is −10 degrees, the fixing temperature will decrease by 10 degrees in a case of executing a correction.

Figure 8:
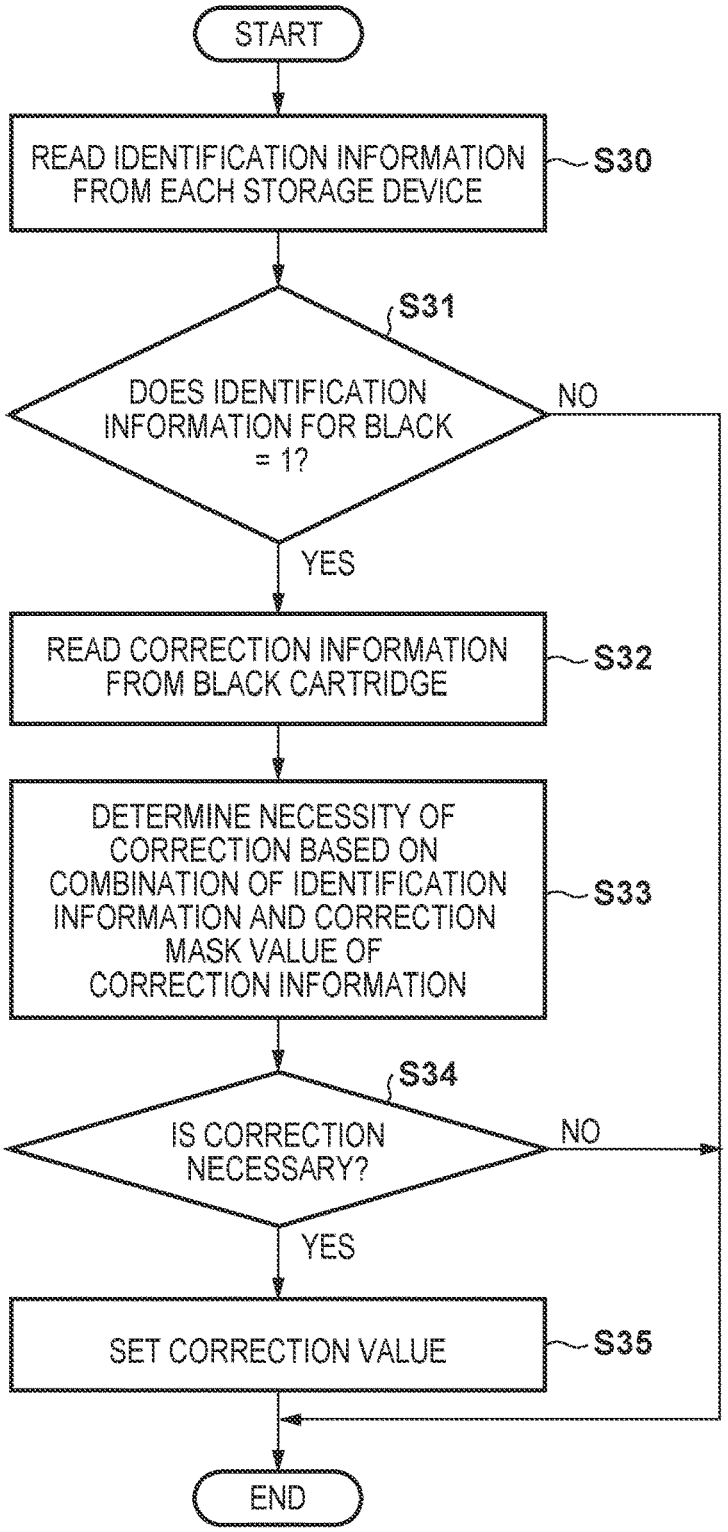
FIG. 8 is a flowchart of correction of the image forming condition according to an embodiment.

FIG. 8 is a flowchart of correction processing of the image forming condition according to the present embodiment. In step S30, the correction determination unit 120 reads the identification information from each storage device 6, and in step S31, determines whether the identification information read from the storage device 6*d* of the black cartridge 9*d* is 1. If the identification information is not 1 in step S31, correction is unnecessary, and thus the correction determination unit 120 ends processing. Meanwhile, when the identification information is 1 in step S31, the correction determination unit 120, in step S32, reads the correction information from the storage device 6*d*, and in step S33 and in step S34, as described using FIGS. 7A and 7B, the necessity of correction is determined based on the combined value of the pieces of identification information and the correction mask value for the read correction information. When correction is unnecessary, the correction determination unit 120 ends processing. Meanwhile, when correction is necessary, the correction determination unit 120 updates the image forming condition based on the correction information in step S35.

In the present embodiment, a correction condition is set only for a storage device 6 of a cartridge 9 for which the image forming condition must be changed due to a change of material. By this, it is possible to set an appropriate image forming condition while economizing the capacity of the storage devices 6.

Fourth Embodiment

In the first embodiment, it is envisioned that the cartridge control unit 105 independently controls each member of a cartridge. In other words, it is envisioned that it is possible to individually control the charging biases outputted by respective charging rollers 2*a* through 2*d*, for example. In this case, even if the material of the charging roller 2 is changed, it is possible to individually set an image forming condition with respect to this charging roller 2 irrespective of whether the material of a different charging roller 2 has been changed or not. However, a configuration where the power supply for supplying charging biases to the charging rollers 2*a* through 2*c* of the cartridges 9*a* through 9*c* is common can be considered, for example. Below, description is given for a configuration for setting an appropriate image forming condition even in the case where one image forming condition from among processing for forming an image of at least two different colors on a photosensitive body 1 and processing for transferring the image to the intermediate transfer belt 80 cannot be caused to change for each color and is shared.

Figure 9:
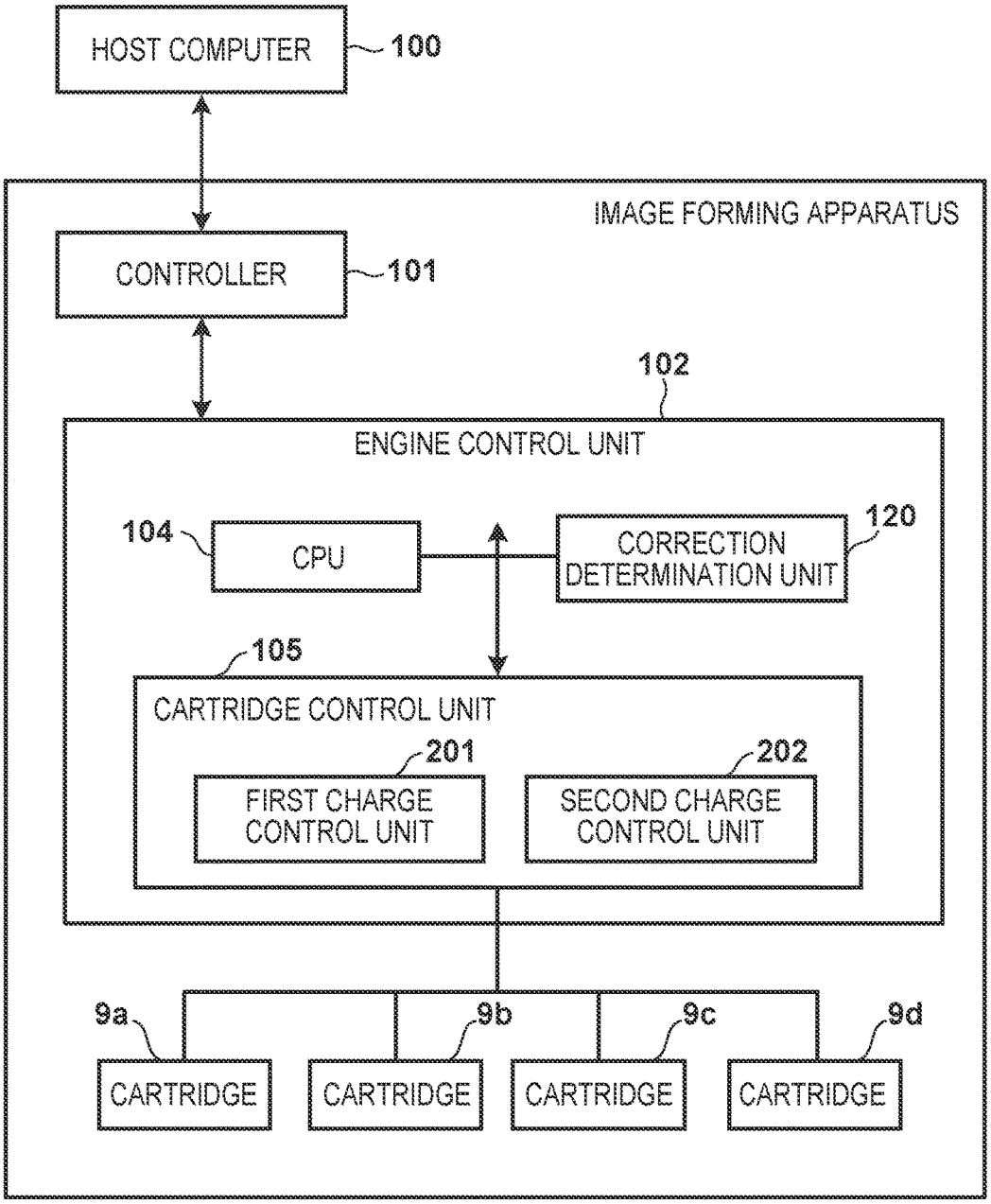
FIG. 9 is a control configuration diagram of the image forming apparatus according to an embodiment.

FIG. 9 is a control configuration diagram of the image forming apparatus according to this embodiment. Note that the same reference numerals are added for control configurations of the first embodiment illustrated in FIG. 2 and similar configuration elements thereof, and explanation of these is omitted. In the present embodiment, it is assumed that configuration is taken such that a charging bias is supplied from a single common power supply unit to the charging rollers 2*a* through 2*c*, and a charging bias from another power supply unit is supplied to the charging roller 2*d*. Accordingly, the cartridge control unit 105 is provided with a first charge control unit 201 for controlling the charging bias common to the charging rollers 2*a* through 2*c*, and a second charge control unit 202 for controlling the charging bias for the charging roller 2*d*.

Figure 10:
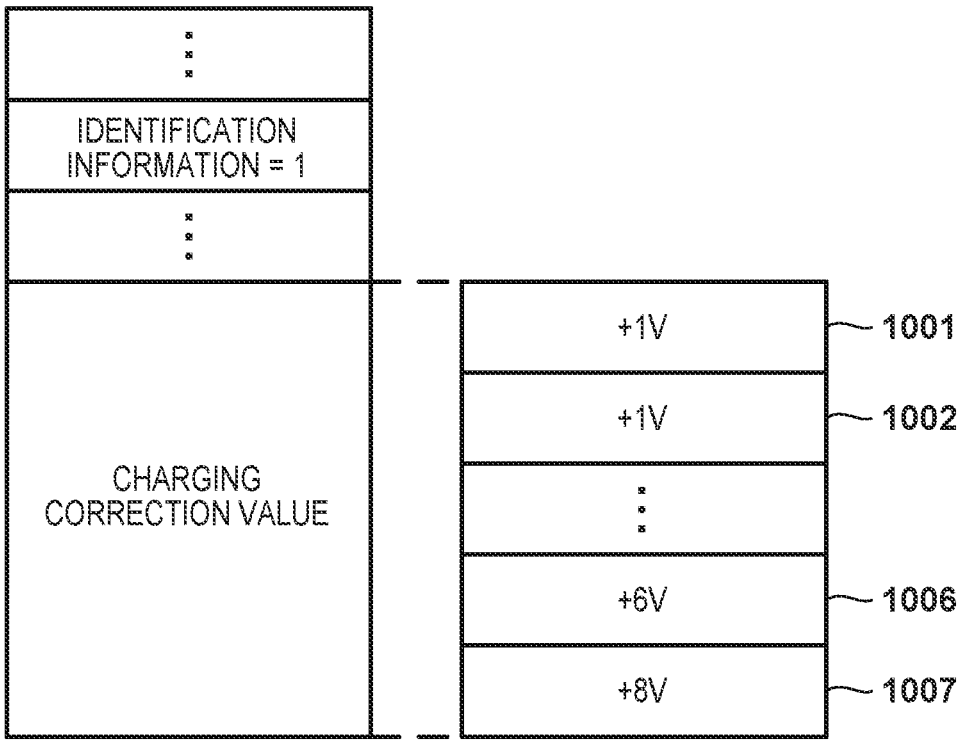
FIG. 10 is a view illustrating information stored in the storage device according to an embodiment.

FIG. 10 is a view for describing information stored in the storage devices 6*a* through 6*c* in the present embodiment. The identification information is information indicating whether the material of the charging roller has been changed, and the identification information being 0 indicates that it has not been changed, and the identification information being 1 indicates that it has been changed. When the identification information is 1, correction information is stored in a predetermined region of the storage device 6. Here, because the charging bias common to the three charging rollers 2*a* through 2*c* is a control target in the present embodiment, there are eight combinations of values for identification information stored in the storage devices 6*a* through 6*c*. Here, because all of the identification information is 0 for the three storage devices 6, correction of the charging bias which is an image forming condition that is a control target in the present embodiment is not necessary, and seven correction values are set to a charging correction value which is correction information.

Similarly to in the first embodiment, the combined value of identification information is represented by lining up values for identification information in the order of the storage devices 6*a*, 6*b*, and 6*c* in the present embodiment. For example, when the identification information of the storage devices 6*a* and 6*b* is 1 and the identification information of the storage device 6*c* is 0, the combined value is "110". A reference numeral 1001 of FIG. 10 is a correction value applied when the combined value is "001", and a reference numeral 1002 is a correction value applied when the combined value is "010". In addition, a reference numeral 1006 is a correction value applied when the combined value is "110", and a reference numeral 1007 is a correction value applied when the combined value is "111".

For example, when the identification information for the storage devices 6*a* and 6*b* is 1 and the identification information for the storage device 6*c* is 0, the combined value is "110", and the correction determination unit 120 notifies the first charge control unit 201 to increase the charging bias by just 6V.

Note that, in the present embodiment, an image forming condition that is a control target is given as a charging bias (a charging condition) common to the charging rollers 2*a* through 2*c*, but the present invention is not limited to such a configuration. An image forming condition common to a plurality of members can be a developing bias (a developing condition), a primary transfer bias (a primary transfer condition), or exposure intensity (an exposure condition). Furthermore, it is possible to have members with a common image forming condition be any combination of the same members for forming toner images of yellow, cyan, magenta, and black. In addition, a member whose identification information indicates a change of a material is changed to something corresponding to a member having a common image forming condition. By the above configuration, it is possible to set an appropriate image forming condition even in the case where there is a common image forming condition with respect to at least two out of the same member for forming images of different colors.

Fifth Embodiment

Subsequently, description is given regarding the fifth embodiment focusing on points of difference with the first through fourth embodiments. In the first through fourth embodiment, description was given by taking as an example a color image forming apparatus provided with the cartridges 9*a* through 9*d* of a plurality of colors. However, the present invention is not limited to such a configuration. Application to a monocolor image forming apparatus is also possible.

Figure 11:
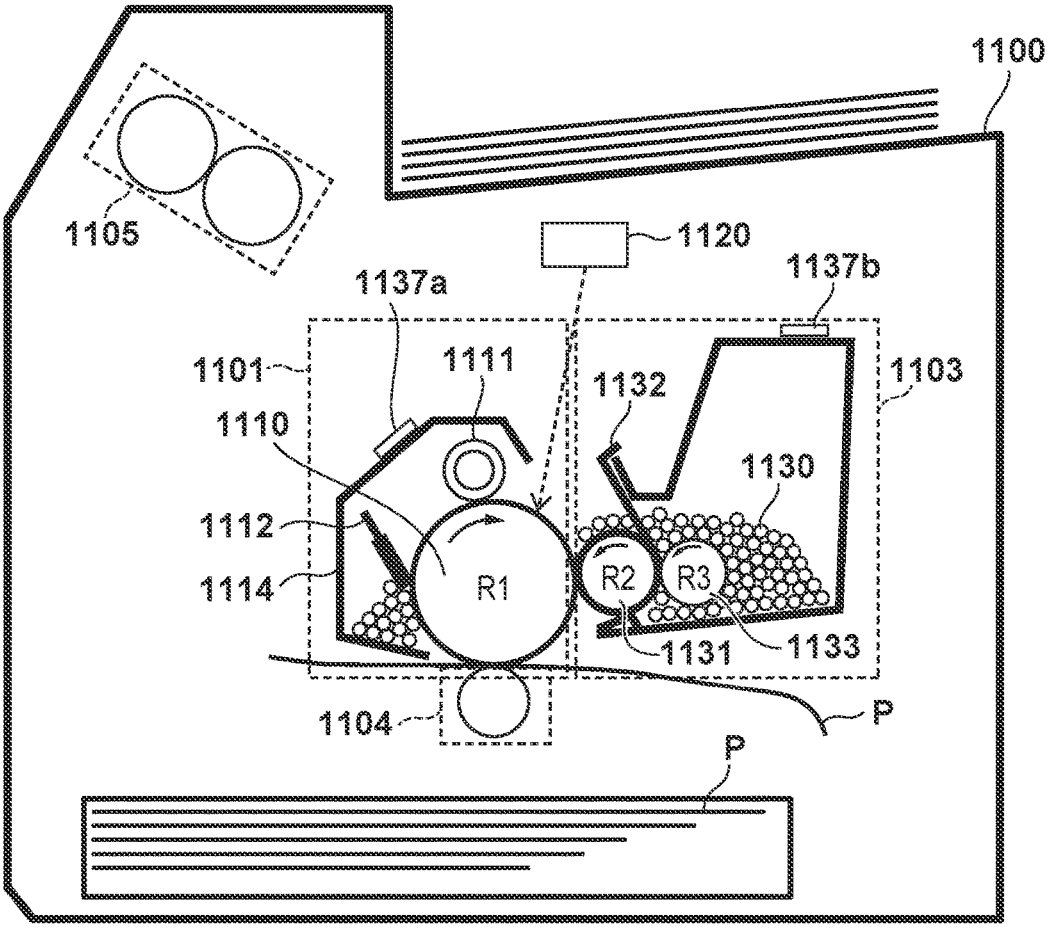
FIG. 11 is a configuration diagram of the image forming apparatus according to an embodiment.

FIG. 11 is a configuration diagram of the image forming apparatus according to this embodiment. An image forming apparatus of FIG. 11 is provided with at least a cleaning cartridge (a photosensitive unit) 1101, an exposure apparatus 1120, a development cartridge (developer unit) 1103, a transfer apparatus 1104, and a fixing apparatus 1105 in an apparatus main body 1100 of the image forming apparatus. In addition, the cleaning cartridge (photosensitive unit) 1101 and the development cartridge (developer unit) 1103 are each independently detachable from the apparatus main body 1100.

The cleaning cartridge 1101 has a cleaning frame 1114, a photosensitive drum 1110 which is an image carrier, a charging roller 1111 which is a charging member, a cleaning blade 1112 which is a cleaning member, and a storage element 1137*a*. In the present embodiment, because there are two cartridge bodies, the storage element 1137*a* held by the cleaning cartridge is set as a first storage element, and a storage element 1137*b* of the development cartridge 1103 which is described later is set as a second storage element.

The development cartridge 1103 of the present embodiment has a single component developer 1130 (hereinafter referred to as "toner") which has a negative chargeability and is used in image formation. The development cartridge 1103 has a developing roller 1131 which is a developer carrier, a developing blade 1132 which is a developer regulation member, a supply roller 1133 for supplying toner to the developer carrier, and a storage element 1137*b* such as a non-volatile memory.

Figure 12:
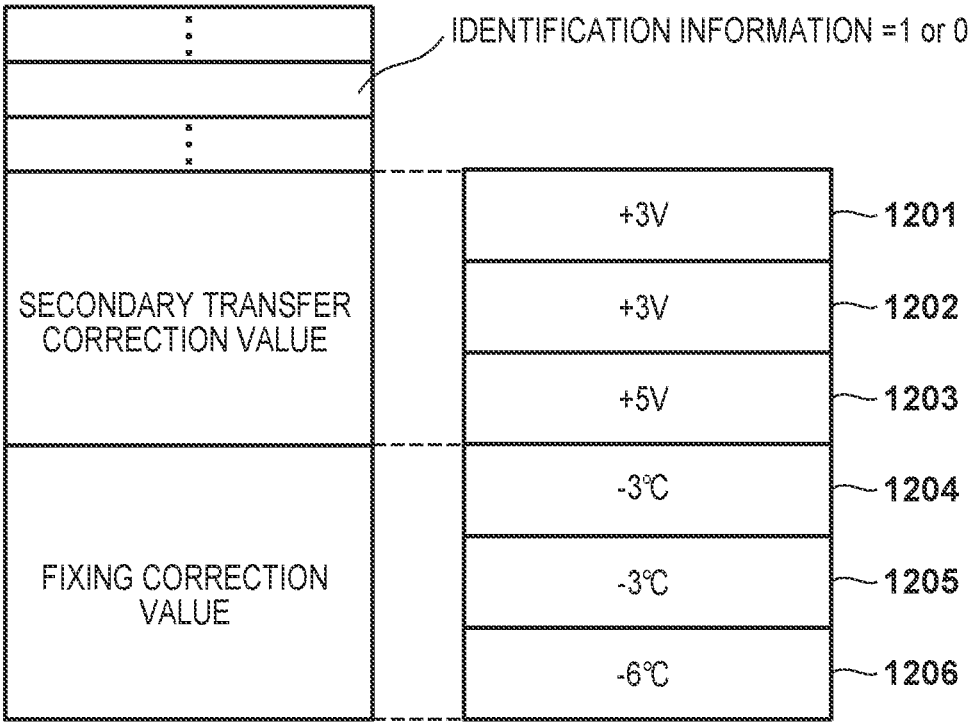
FIG. 12 is a view illustrating information stored in the storage device according to an embodiment.

FIG. 12 is a view for describing information stored in the storage devices 1137*a* and 1137*b* in the present embodiment. Identification information is information indicating whether material of toner or a constituent component has been changed. In the case of the cleaning cartridge 1101, the identification information being 0 indicates that the material of the photosensitive drum 1110 has not been changed from an initial material. It is assumed that identification information being 1 indicates that the material of the photosensitive drum 1110 has been changed from an initial material. In addition, in the case of the development cartridge 1103, the identification information being 0 indicates that the material of the developer 1130 or the developing roller 1131 has not been changed from an initial material. The identification information being 1 indicates that the material of the developer 1130 or the developing roller 1131 has been changed from initial material.

When 1 is obtained as identification information from any cartridge, correction information is stored in a predetermined region of the storage devices 1137*a* and 1137*b*. In the present embodiment, because image forming conditions that are the control targets are the secondary transfer bias and the fixing temperature, each of a secondary transfer correction value and a fixation correction value are stored as correction information. Here, image formation is performed with two cartridges 1101 and 1103 installed in the present embodiment, and there are 4 combinations of identification information values stored in respective storage devices 1137*a* and 1137*b*. Out of these, because there is no necessity for correction of the image forming condition for the combination where the identification information of all of the storage devices 1137*a* and 1137*b* is 0, three correction values are set for each of the secondary transfer correction value and the fixation correction value.

Note that, in the following description, a combination of values of identification information stored in the two storage devices 1137*a* and 1137*b* is represented by a combined value that lines up the values of the identification information in the order of the storage devices 1137*a* and 1137*b*. For example, when the identification information of the storage device 1137*a* is 1 and the identification information of the storage device 1137*b* is 0, the combined value is "10".

In relation to the secondary transfer correction value, a reference numeral 1201 of FIG. 12 is a correction value applied when the combined value is "01", and a reference numeral 1202 is a correction value applied when the combined value is "10". In addition, a reference numeral 1203 is a correction value to apply when the combined value is "11". Similarly for fixation correction values, a reference numeral 1204 of FIG. 12 is a correction value applied when the combined value is "01", and a reference numeral 1205 is a correction value applied when the combined value is "10". In addition, a reference numeral 1206 is a correction value to apply when the combined value is "11".

For example, when the identification information of both of the storage devices 1137*a* and 1137*b* is 1, the combined value is "11". In such a case, the correction determination unit 120 notifies the secondary transfer control unit 113 to cause the secondary transfer bias to increase by 5V from a reference value, and notifies the fixing control unit 114 to cause the fixing temperature to decrease by 6 degrees from a reference value. Note that the reference value of the secondary transfer bias and the reference value of the fixing temperature are set in the image forming apparatus in advance, for example. Alternatively, the reference value of the secondary transfer bias or the reference value of the fixing temperature is obtained by the image forming apparatus in accordance with a calculation based on an ambient state or the like at the time, based on a parameter set in the image forming apparatus in advance. In addition, a flowchart representing detailed processing of the correction determination unit 120 is similar to the flowchart described by FIG. 4, and thus description in detail is omitted.

By disclosure of each embodiment above, it is possible to set an appropriate image forming condition even if cartridges having different versions are mixed and installed.

OTHER EMBODIMENTS

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-112025, filed Jun. 6, 2017, and No. 2018-071044, filed Apr. 2, 2018, which are hereby incorporated by reference herein in their entirety.

What is claimed is:

1. An image forming apparatus, comprising:

a formation unit configured to form an image, the formation unit including a plurality of cartridges that are detachable from the image forming apparatus, each cartridge having a storage unit and a member; and a controller configured to set an image forming condition for image formation, wherein the controller reads identification information from each storage unit of at least two cartridges from among the plurality of cartridges, the identification information indicating a version of a corresponding cartridge, and the controller reads a correction value stored in at least one of the storage units, and sets the image forming condition based on the correction value, the correction value corresponding to a combination of versions of the at least two cartridges.

2. The image forming apparatus according to claim 1, wherein the storage unit of a cartridge of a version different from an initial version from among the at least two cartridges stores correction information for the image forming condition, and if a version of at least one cartridge from among the at least two cartridges differs from the initial version, the controller sets the image forming condition based on the correction information stored in the storage unit of the cartridge of the version different from the initial version from among the at least two cartridges.

3. The image forming apparatus according to claim 2, wherein the correction information includes information indicating a relationship between a combination of versions and the correction value for the image forming condition.

4. The image forming apparatus according to claim 3, wherein the information indicating the relationship between the combination of versions and the correction value for the image forming condition is information that includes a value indicating the correction value for a correction reference value or a value indicating a ratio of the correction value with respect to the correction reference value, for each combination of versions and the correction reference value of the image forming condition.

5. The image forming apparatus according to claim 2, wherein, when there are a plurality of versions different from the initial version for the at least two cartridges, the controller sets the image forming condition based on the correction information stored in the storage unit of a cartridge of a newest version from among the at least two cartridges.

6. The image forming apparatus according to claim 2, wherein the storage unit of a cartridge having a version different from the initial version stores correction information relating to a combination that includes among combinations of versions, the combination including the version of the cartridge.

7. The image forming apparatus according to claim 1, wherein the at least two cartridges include a first cartridge for which correction information is stored in a storage unit in a case that a version is different from an initial version, and a second cartridge for which the correction information is not stored in a storage unit irrespective of a version, and the controller sets the image forming condition based on the correction information stored in the storage unit of the first cartridge when a version of the first cartridge differs from the initial version.

8. The image forming apparatus according to claim 7, wherein the first cartridge is a cartridge for forming a black image.

9. The image forming apparatus according to claim 7, wherein the correction information includes information indicating a relationship between the correction value of the image forming condition and a combination of versions for applying the correction value.

10. The image forming apparatus according to claim 1, wherein the at least two cartridges are all of the plurality of cartridges, and the image forming condition includes a transfer condition for transferring an image to a sheet, or a fixing condition for causing an image transferred to a sheet to be fixed to the sheet.

11. The image forming apparatus according to claim 1, wherein the formation unit forms an image of a different color on a photosensitive member included in each of the plurality of cartridges as the member, transfers the image formed on the photosensitive member included in each of the plurality of cartridges to a transfer body, transfers the image transferred to the transfer body to a sheet, and causes the image to be fixed to the sheet, to thereby form the image on the sheet, and the image forming condition is a condition for transferring at least two images of different colors formed on photosensitive members of the at least two cartridges to the transfer body, or for forming an image on each photosensitive member of the at least two cartridges.

12. The image forming apparatus according to claim 1, wherein the identification information indicates a version of a material of a member included in a corresponding cartridge.

13. The image forming apparatus according to claim 1, wherein the identification information indicates a version of a material of toner included in a corresponding cartridge.

14. A cartridge detachable from an image forming apparatus, the cartridge comprising:

a storage unit configured to store identification information indicating a version of the cartridge and a correction value so that the image forming apparatus can read the correction value and set an image forming condition based on the correction value, the correction value corresponding to a combination of versions of at least two cartridges installed in the image forming apparatus.

15. The cartridge according to claim 14, wherein the storage unit further stores correction information indicating a relationship between the correction value for the image forming condition and a combination of versions.

16. The cartridge according to claim 15, wherein the correction information indicates a relationship between the correction value of the image forming condition and a combination that includes a version of the cartridge.

17. The cartridge according to claim 15, wherein the information indicating the relationship between the combination of versions and the correction value for the image forming condition is information that includes a value indicating the correction value for a correction reference value or a value indicating a ratio of the correction value with respect to the correction reference value, for each combination of versions and the correction reference value of the image forming condition.

18. The cartridge according to claim 15, wherein the correction information is information indicating a relationship between the correction value for the image forming condition and the combination of versions for applying the correction value.

19. The cartridge according to claim 15, wherein the cartridge comprises a photosensitive member, a charger configured to cause charging of the photosensitive member, and a developing unit configured to form a toner image on the photosensitive member by developing, by toner, an electrostatic latent image formed on the photosensitive member by exposing the charged photosensitive member.

20. The cartridge according to claim 14, wherein the image forming condition includes any of a charging condition, an exposure condition, a developing condition, a primary transfer condition, a secondary transfer condition, and a fixing condition.

* * * * *